US008795019B2

(12) United States Patent
Ohno et al.

(10) Patent No.: US 8,795,019 B2
(45) Date of Patent: Aug. 5, 2014

(54) ELECTRODE MOUNT, HIGH PRESSURE DISCHARGE LAMP USING THE SAME, AND MANUFACTURING METHODS OF ELECTRODE MOUNT AND HIGH PRESSURE DISCHARGE LAMP

(75) Inventors: Atsushi Ohno, Gyoda (JP); Kazushi Tominaga, Gyoda (JP); Shinichi Takemasa, Gyoda (JP)

(73) Assignee: Iwasaki Electric Co., Ltd, Chuo-ku, Tokyo (JP)

( * ) Notice: Subject to any disclaimer, the term of this patent is extended or adjusted under 35 U.S.C. 154(b) by 22 days.

(21) Appl. No.: 13/395,733

(22) PCT Filed: Jun. 28, 2011

(86) PCT No.: PCT/JP2011/064770

§ 371 (c)(1),
(2), (4) Date: Mar. 13, 2012

(87) PCT Pub. No.: WO2012/035846

PCT Pub. Date: Mar. 22, 2012

(65) Prior Publication Data

US 2012/0286656 A1 Nov. 15, 2012

(30) Foreign Application Priority Data

Sep. 14, 2010 (JP) ..... 2010-205008

(51) Int. Cl.

| | |
|---|---|
| ***H01J 9/00*** | (2006.01) |
| ***H01J 61/36*** | (2006.01) |
| ***H01J 61/20*** | (2006.01) |
| ***H01J 9/32*** | (2006.01) |
| ***H01J 61/86*** | (2006.01) |
| ***H01J 9/28*** | (2006.01) |

(52) U.S. Cl.

CPC ..... *H01J 9/28* (2013.01); *H01J 61/368* (2013.01); *H01J 61/20* (2013.01); *H01J 9/32* (2013.01); *H01J 61/86* (2013.01); *H01J 9/323* (2013.01)

USPC ..... 445/58; 445/22; 445/26; 313/568; 313/623; 313/624; 313/625; 313/633; 313/635; 313/639

(58) Field of Classification Search

USPC ..... 313/658, 623–625, 635, 639, 568, 633; 445/22, 26, 58

See application file for complete search history.

(56) References Cited

U.S. PATENT DOCUMENTS 6,600,266 B1 7/2003 Nakagawa (Continued)

FOREIGN PATENT DOCUMENTS

EP 0 903 771 3/1999

(Continued)

OTHER PUBLICATIONS

Notification of Transmittal of Translation of the International Preliminary Report on Patentability (Application No. PCT/JP2011/064770) dated Apr. 18, 2013.

(Continued)

*Primary Examiner* — Thomas A Hollweg

(74) *Attorney, Agent, or Firm* — Eric J. Robinson; Robinson Intellectual Property Law Office, P.C.

(57) ABSTRACT

To prevent bending of an electrode shaft portion by a method which requires minimum increase in production cost, in an electrode mount for a high pressure discharge lamp. A manufacturing method of an electrode mount for the high pressure discharge lamp includes: a process of subjecting the electrode mount to a heat treatment, the electrode mount including an electrode and a metal foil which are welded to each other; and an oxidation process of producing an oxide on a surface of the electrode shaft portion of the electrode by laser irradiation to form an oxidation portion on the surface, wherein a laser irradiation position is determined such that a whole or part of the oxidation portion is included in a sealing portion of the high pressure discharge lamp when the electrode mount is embedded in the sealing portion.

4 Claims, 3 Drawing Sheets

(56) References Cited

U.S. PATENT DOCUMENTS

| | | | | |
|---|---|---|---|---|
| 7,115,012 | B2 * | 10/2006 | Aya et al. | 445/26 |
| 2002/0017860 | A1 * | 2/2002 | Nishida et al. | 313/568 |
| 2003/0042856 | A1 * | 3/2003 | Kaneko et al. | 313/639 |
| 2004/0033753 | A1 * | 2/2004 | Aya et al. | 445/26 |
| 2004/0150343 | A1 * | 8/2004 | Takahashi et al. | 313/623 |
| 2005/0003729 | A1 * | 1/2005 | Mizobe | 445/22 |
| 2006/0119264 | A1 | 6/2006 | Homma et al. | |
| 2011/0095683 | A1 * | 4/2011 | Yokota et al. | 313/623 |

FOREIGN PATENT DOCUMENTS

| | | |
|---|---|---|
| EP | 1 154 460 | 11/2001 |
| JP | 2001-023571 | 1/2001 |
| JP | 2009-099338 | 5/2009 |
| JP | 2009-146590 | 7/2009 |

OTHER PUBLICATIONS

International Search Report for Application Serial No. PCT/JP2011/064770 dated Aug. 30, 2011.

European Search Report (Application No. 11824309.6) dated Mar. 19, 2014.

* cited by examiner

ELECTRODE MOUNT, HIGH PRESSURE DISCHARGE LAMP USING THE SAME, AND MANUFACTURING METHODS OF ELECTRODE MOUNT AND HIGH PRESSURE DISCHARGE LAMP

TECHNICAL FIELD

The present invention generally relates to an electrode mount, a high pressure discharge lamp using the same, and manufacturing methods of the electrode mount and the high pressure discharge lamp. More specifically, the present invention relates to an electrode mount for preventing bending of an electrode shaft portion embedded in a sealing portion and to the high pressure discharge lamp using the same.

BACKGROUND ART

FIG. 7 shows a general high pressure discharge lamp 11 (for example, an ultra high pressure mercury lamp) used as a light source for a projector or the like. The high pressure discharge lamp 11 is formed of a bulb 2 and a pair of electrode mounts included in the bulb 2. The bulb 2 is formed of a discharge space 3 and a pair of sealing portions 4 having the discharge space 3 disposed therebetween. Each of the electrode mounts is formed of an electrode 5, a metal foil 6, and a lead wire 7 welded to one another. A front end side of the electrode 5 is exposed to the discharge space 3 of the bulb 2, and part of an electrode shaft portion 5*a* on a base side of the electrode 5, the metal foil 6, and part of the lead wire 7 are embedded in the sealing portion 4. The discharge space 3 is filled with 0.15 mg/mm$^3$ or more of mercury, a noble gas, and a halogen gas, and the mercury vapor pressure during its operation is 150 atmospheres or more.

Incidentally, the high pressure discharge lamp (hereafter, referred to as "lamp"), when used, is repeatedly turned on and off and has such a problem that the electrode shaft portion is bent when the lamp is turned on and off, which is caused by difference in coefficient of thermal expansion between the electrode shaft portion (tungsten) and the sealing portion (quartz glass). The mechanism of how the bending of the electrode shaft portion occurs is as follows. First, when the lamp is turned on, the electrode shaft portion expands in a radial direction and also expands toward the discharge space. Meanwhile, quartz glass of the sealing portion hardly expands compared to the electrode shaft portion since the coefficient of thermal expansion of quartz glass is far smaller than that of the electrode shaft portion. The electrode shaft portion expands while quartz glass of the sealing portion maintains its shape. This causes the electrode shaft portion to adhere to part of the sealing portion. Thereafter, when the lamp is turned off, the electrode shaft portion contracts to return to an original position. At this time, the adhering portion of the electrode shaft portion maintains this state while other portions moves away and become separated from the quartz glass (a gap is formed). In other words, contraction is restricted in the adhering portion of the electrode shaft portion while contraction is not restricted in a gap portion and, as a result, the electrode shaft portion is bent. The bending of electrode shaft portion causes problems such as misalignment of optical axis and reduction in illuminance.

To solve the problem of the bending of electrode shaft portion described above, Patent Document 1 describes the following configuration. A tapered portion which becomes narrower from a base to a front end is provided in an electrode shaft portion and contraction of the electrode shaft portion is thereby made less likely to be restricted by quartz glass of a sealing portion.

Moreover, in Patent Document 2, an inner surface of a sealing portion (quartz glass) and an outer surface of an electrode shaft portion are configured to support each other with a contact portion therebetween being made small. This prevents the inner surface of the sealing portion (quartz glass) from inhibiting expansion and contraction of the electrode shaft portion. Specifically, a contact portion with the electrode shaft portion is made small by configuring an inner surface structure of the sealing portion (quartz glass) in such a manner that a cross-section of the inner surface structure has a shape such as a triangle or includes a protruding portion.

CITATION LIST

Patent Literature

PTL 1: Japanese Patent Application Laid-open No. 2009-99338

PTL 2: Japanese Patent Application Laid-open No. 2009-146590

SUMMARY OF INVENTION

Technical Problem

However, in the Patent Document 1, the configuration of the electrode shaft portion is complex and a processing cost in the production of the electrode is thereby drastically increased. Moreover, the electrode shaft portion has to be designed to secure strength in a narrow part of the tapered portion but increasing the thickness of the entire electrode shaft portion causes the heat capacity thereof to exceed a desired range. Furthermore, since a high precision is required for the processing of the electrode, the shape of the electrode is desirably made as simple as possible to achieve a high yield.

Also in the Patent Document 2, the processing of the sealing portion is complex and a processing cost in the production of the bulb is thereby drastically increased. Particularly, regarding the sealing portion, a problem of crack due to a thermal stress also needs to be considered in addition to the problem described above, and the sealing portion is desirably configured such that a stress of quartz glass itself or a stress from the electrode shaft portion is uniformly distributed in a radial direction. Accordingly, it is desirable that the cross section of the sealing portion has a circular shape.

An object of the present invention is therefore to provide the electrode mount for preventing bending of electrode shaft portion by using a method requiring a minimal increase in production cost, in the electrode for a high pressure discharge lamp. Moreover, another object of the present invention is to find a configuration effective even in a configuration capable of inputting a large current in a high-wattage lamp.

Solution to Problem

A first aspect of the present invention is a manufacturing method of an electrode mount for a high pressure discharge lamp. The manufacturing method includes: a process of subjecting the electrode mount to a heat treatment, the electrode mount including an electrode and a metal foil which are welded to each other; and an oxidation process of producing an oxide on a surface of an electrode shaft portion of the electrode by laser irradiation to form an oxidation portion on the surface. A laser irradiation position is determined such that a whole or part of the oxidation portion is included in a sealing portion of the high pressure discharge lamp when the electrode mount is embedded in the sealing portion.

A second aspect of the present invention is a manufacturing method of a high pressure discharge lamp. The manufacturing method includes the processes of: subjecting an electrode mount to a heat treatment, the electrode mount having an electrode and a lead wire welded respectively to both ends of a metal foil; producing an oxide on a surface of an electrode shaft portion of the electrode by laser irradiation to form an oxidation portion on the surface; and embedding the electrode mount in a bulb of the high pressure discharge lamp and forming a sealing portion. A laser irradiation position is determined such that a whole or part of the oxidation portion is included in the sealing portion.

A third aspect of the present invention is an electrode mount for a high pressure discharge lamp. The electrode mount includes a metal foil and an electrode welded to one end of the metal foil. An oxidation portion is formed where an oxide produced by laser irradiation is formed on a surface of an electrode shaft portion, and the oxidation portion is formed such that a whole or part of the oxidation portion is included in a sealing portion of the high pressure discharge lamp when the electrode mount is embedded in the sealing portion.

A fourth aspect of the present invention is a high pressure discharge lamp including: the electrode mount of the third aspect further including a lead wire connected to another end of the metal foil; and a bulb including the electrode mount in the sealing portion.

In the first and second aspects, the oxidation process preferably includes determining an intensity of a laser such that the oxidation portion is formed on an entire peripheral surface of the electrode shaft portion by irradiating one side of the electrode shaft portion with the laser.

Moreover, in the first to fourth aspects, it is preferable that (1) the oxidation portion is formed to cover at least 30% of an embedded portion of the electrode shaft portion on a discharge space side or (2) the oxidation portion is formed to cover at least 65% of the embedded portion of the electrode shaft portion.

DESCRIPTION OF EMBODIMENTS

Figure 1:
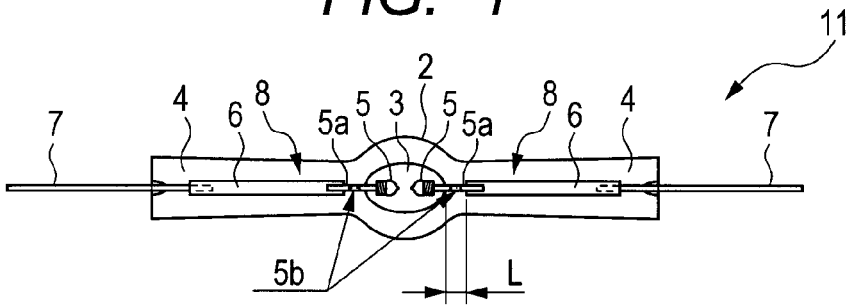
FIG. 1 is a view of a high pressure discharge lamp of the present invention.

FIG. 1 shows a high pressure discharge lamp 1 including electrode mounts of the present invention. The high pressure discharge lamp 1 is formed of a bulb 2 and a pair of electrode mounts 8 (see FIG. 3A). The bulb 2 is formed of a discharge space 3 and a pair of sealing portions 4 having the discharge space 3 disposed therebetween. Each of the electrode mounts 8 is formed of an electrode 5, a metal foil 6, and a lead wire 7 welded to one another. A discharge side of the electrode 5 is exposed to the discharge space 3 and part of an electrode shaft portion 5*a*, the metal foil 6, and part of the lead wire 7 are embedded in the sealing portion 4. Moreover, an oxidation portion 5*b* in which an oxide is produced (hereafter, referred to as "oxidation portion 5*b*") is formed in the embedded part of the electrode shaft portion 5*a*. The discharge space 3 is filled with 0.15 mg/mm$^3$ or more of mercury, a noble gas, and a halogen gas, and the mercury vapor pressure during the its operation is 150 atmospheres or more.

An effect and advantage obtained by forming the oxidation portion 5*b* in the embedded portion of the electrode shaft portion 5*a* as described above is as follows. The electrode shaft portion 5*a* is made of tungsten and the oxidation portion 5*b* is thereby tungsten oxide. Tungsten has a low adhesion with tungsten oxide. Meanwhile, quartz glass has a high adhesion with tungsten oxide since quartz glass has a high reducibility. Accordingly, even if part of the oxidation portion 5*b* of the electrode shaft portion 5*a* adheres to quartz glass of the sealing portion 4 during the time when the lamp is turned off, i.e. when the lamp is cooled, contraction of the electrode shaft portion 5*a* is not inhibited by the partial adhesion between the oxidation portion 5*b* and the sealing portion 4 since the electrode shaft portion 5*a* is less likely to adhere to the oxidation portion 5*b*. Specifically, when the oxidation portion 5*b* is formed in a contact portion between the electrode shaft portion 5*a* and the sealing portion 4, the electrode shaft portion 5*a* expands with uniformity (in a state where a stress is applied almost uniformly in a radial direction and an axial direction) when the lamp is turned on and contracts to return to an original position when the lamp is turned off. In other words, the oxidation portion 5*b* functions as a buffer material. The configuration described above can prevent bending of the electrode shaft portion caused by repeatedly turning the lamp on and off.

Note that, the oxidation portion 5*b* is desirably formed over an entire peripheral surface of the electrode shaft portion 5*a* to obtain its uniformity in the radial direction and the axial direction as described above. However, as long as the oxidation portion 5*b* serves the aforementioned function as the buffer material, the advantage of the present invention can be obtained even when the oxidation portion 5*b* is not formed over the entire periphery.

Figure 2:
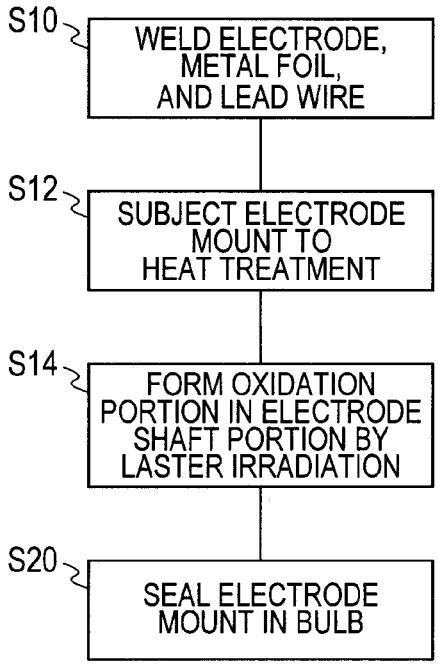
FIG. 2 is a flowchart of a manufacturing method of an electrode mount and the high pressure discharge lamp of the present invention.

FIG. 2 shows a flowchart of a manufacturing method of the electrode mount and the lamp of the present invention.

Figure 3A:
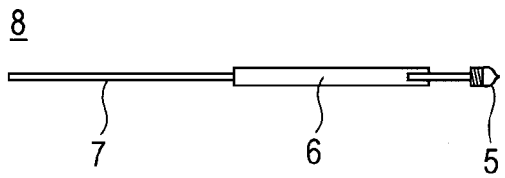
FIG. 3A is a view for explaining the manufacturing method of the electrode mount of the present invention.

In step S10, the electrode mount 8 is formed by welding the electrode 5 to one end of the metal foil 6 and welding the lead wire 7 to the other end thereof as shown in FIG. 3A. An electric resistance welding can be used for welding. Moreover, the lead wire 7 may be welded to the metal foil 6 after step S12 or S14 to be described later.

In step S12, the electrode mount 8 obtained in step S10 is subjected to a heat treatment. The heat treatment is performed by exposing the electrode mount 8 to a hydrogen atmosphere of 900° C. to 1000° C. for ten minutes. Impurities on the electrode mount are removed by this treatment.

Figure 3B:
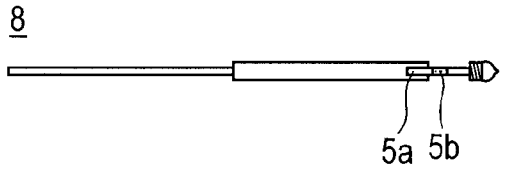
FIG. 3B is a view for explaining the manufacturing method of the electrode mount of the present invention.

In step S14, as shown in FIG. 3B, the oxidation portion 5*b* is formed in a predetermined portion of the surface of the electrode shaft portion 5*a*. The position of the electrode shaft portion 5*a* is determined such that the whole or part (most part) of the oxidation portion 5*b* is included in the sealing portion 4 when the electrode mount 8 is embedded in the sealing portion 4 in step S20 to be described later. In other words, the oxidation portion 5*b* may be completely embedded in the sealing portion 4 or may be slightly exposed to the discharge space 3. In actual, it is desirable that the oxidation portion 5*b* is provided in such a manner that the oxidation portion 5*b* is slightly exposed to the discharge space 3, in consideration of manufacturing variations. The electrode mount 8 of the present invention is thus completed.

An oxidation process of step S14 is performed by irradiating the surface of the electrode shaft portion 5*a* with a laser. Specifically, SUPER-LASER MAX-150P (main body) and MODEL FOL-30-THM II-F/100-WD100 output diameter ϕ0.8 mm (output unit) manufactured by THM Co., Ltd may be used as the laser irradiation device. Then, one side of the electrode shaft portion 5*a* is irradiated with the laser with the distance from the output unit to the electrode shaft portion 5*a* being set to 90 mm and the output intensity of the laser is determined and set such that the oxidation portion is formed on an entire peripheral surface of the electrode shaft portion 5*a*. As described above, there is no need to turn the electrode shaft portion 5*a* or the laser irradiation device with respect to an electrode axis when the oxidation portion is provided on the entire peripheral surface. Thus, the oxidation process can be performed easily.

Figure 3C:
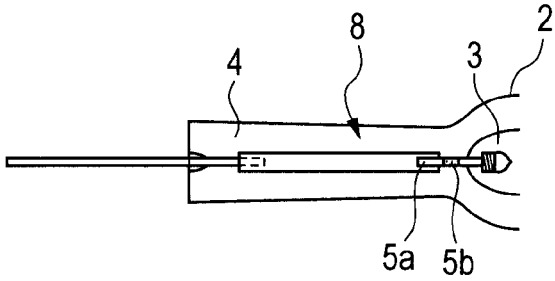
FIG. 3C is a view for explaining a process of forming a sealing portion of the present invention.

In step S20, as shown in FIG. 3C, the electrode mount 8 is embedded in the bulb 2 and the sealing portion 4 is formed. As described above, in this process, the whole or part (most part) of the oxidation portion 5*b* of the electrode shaft portion 5*a* is embedded in the sealing portion 4 while the discharge space 3 is filled with mercury and filler gases. Thus, the high pressure discharge lamp of the present invention is completed.

As described above, the electrode mount for preventing the bending of the electrode shaft portion can be provided by simply adding the laser irradiation process to the conventional manufacturing method of the electrode mount or the lamp.

Next, results obtained by confirming the advantages and the like of the present invention are shown.

<Experiment 1>

Descriptions are given of the specifications of lamps used in Experiment 1. The bulb 2 is made of a high-purity quartz glass and the internal volume of the discharge space 3 is 0.086 cc. The discharge space 3 is filled with about 280 mg/cc of mercury, 20 kPa of a noble gas (for example, argon), and a halogen gas. An input lamp power is 230 W. The electrode shaft portion 5*a* is made of tungsten, a shaft portion diameter is 0.45 mm, a coil is wound around the electrode shaft portion 5*a* on a front end side thereof, and the coil is subjected to a melting process. The length of the embedded portion L of the electrode shaft portion 5*a* is about 2.1 mm. The oxidation portion 5*b* is provided to have a length of about 1 mm from an end portion on a side closer to the metal foil 6, in a direction toward the electrode front end. Note that, in the experiment, the oxidation portion 5*b* is provided only in one electrode shaft portion.

In the experiment, a turning on-off test of 10 minutes ON-10 minutes OFF was performed and it was checked whether the bending of electrode shaft portion occurred or not. The results of the test are shown in Table 1. In the table, "conventional lamp" refers to a lamp provided with no oxidation portion in the configuration described above, "O" indicates that no bending occurred, and "x" indicates that the bending occurred.

TABLE 1

| | Number of times of turning on-off | | | | | | |
|---|---|---|---|---|---|---|---|
| | 60 | 150 | 210 | 270 | 390 | 510 | 840 |
| Conventional lamp | ○ | x | | | | | |
| | ○ | x | | | | | |
| | ○ | ○ | ○ | x | | | |
| Lamp of present invention | ○ | ○ | ○ | ○ | ○ | ○ | ○ |
| | ○ | ○ | ○ | ○ | ○ | x | |
| | ○ | ○ | ○ | ○ | ○ | ○ | ○ |

As can be understood from Table 1, the bending of electrode shaft portion occurred after 150 times of turning on-off in samples of the conventional lamp, and the bending occurred in all of the samples after 270 times. Meanwhile, in the lamp of the present invention, the bending occurred in one of the samples after 510 times. However, no bending occurred in the other two samples even after 840 times of turning on-off. The advantages obtained by forming the oxidation portion in the electrode shaft portion were thus confirmed.

<Experiment 2>

In the experiment, the test was performed by using a lamp having an input lamp power of 420 W. This is a testing condition which is more severe than that of Experiment 1 (230 W) for the electrode shaft portion. Dimensions of the portions of the lamp are different from those of the lamp used in Experiment 1. Particularly, the shaft portion diameter is 0.53 mm, L=2.9 (mm).

Figure 4:
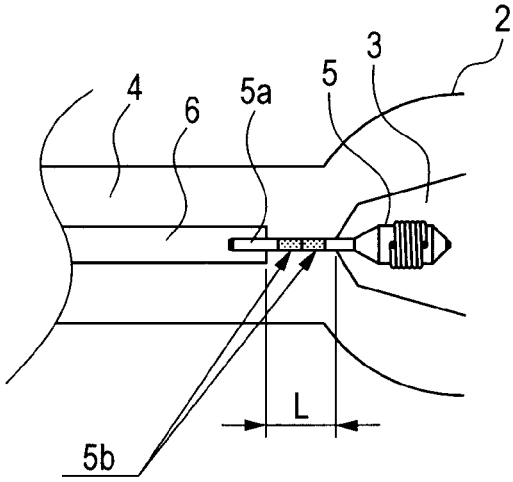
FIG. 4 is a view for explaining a portion where an oxidation portion of the present invention is formed.

The position of the oxidation portion 5*b* is as shown in FIG. 4. Specifically, in the electrode shaft portion 5*a*, a first oxidation portion having a width of 1 mm is formed at a position away from the end portion on the side closer to the metal foil 6 by 0.5 mm in a direction toward the electrode front end. Furthermore, a second oxidation portion having a width of 1 mm is formed at a position substantially continuous with the first oxidation portion. Accordingly, 0.4 mm of the embedded portion is left on the discharge space side of the second oxidation portion. Note that, the position substantially continuous which is described above means that the first oxidation portion and the second oxidation portion are substantially continuous with each other as a result of performing laser irradiation on two portions.

In this experiment also, the turning on-off test of 10 minutes ON-10 minutes OFF was performed, and it was checked whether the bending of electrode shaft portion occurred or not. As a result, it was confirmed that the bending of electrode shaft portion had occurred after 50 times of turning on-off in the conventional lamp. However, no bending occurred even after 1000 times of turning on-off in the lamp of the present invention. The advantages obtained by forming the oxidation portion in the electrode shaft portion were thus confirmed also in this experiment.

<Experiment 3>

Next, a preferable position and a preferable area of the oxidation portion 5*b* were confirmed. No problem occurs when the lamp power is about 230 W, but when the lamp power is about 420 W, particularly, the diameter of the electrode shaft portion needs to be made larger to cope with an increase in heat capacity of the electrode and an increase in the current value. Hence, the degree of expansion and contraction of the electrode shaft portion becomes larger and a preferable position or a preferable area of the oxidation portion 5*b* thereby needs to be determined.

Specifically, in a high-wattage lamp of about 420 W, it is desirable that the position of the oxidation portion 5*b* is desirably on a discharge space side where the temperature becomes higher, in the embedded portion. This is because the stress acting on quartz glass of the sealing portion 4 and the electrode shaft portion 5*a* due to difference in coefficient of thermal expansion therebetween is larger on the discharge side where the temperature becomes higher than that of the metal foil side and it is thereby more efficient to take measures against the bending in that portion. Moreover, as a matter of course, the advantages of the present invention are more difficult to obtain when the oxidation portion 5*b* is not provided in a predetermined area or in an area larger than the predetermined area.

Figure 5:
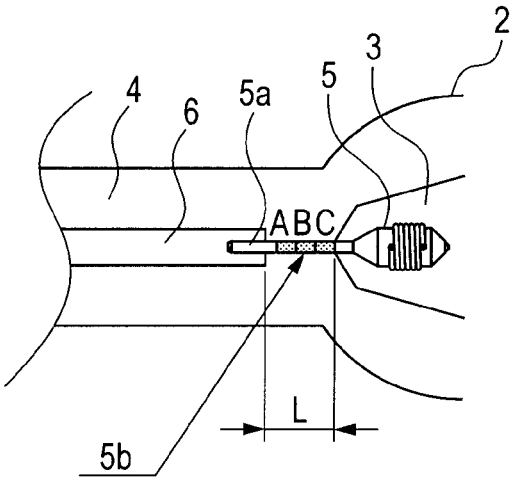
FIG. 5 is a view for explaining portions where the oxidation portion of the present invention is formed.

Experiment 3 was performed to confirm the preferable position and area of the oxidation portion. The specifications of lamps used in Experiment 3 are described with reference to FIG. 5. The lamps are different from the lamp used in Experiment 2 only in the position of the oxidation portion 5*b*. As shown in FIG. 5, portions A, B and C each having a width of 1 mm are defined from the metal foil side end portion of the electrode shaft portion 5*a* to the discharge space side. The turning on-off test similar to Example 2 was performed using lamps each having the oxidation portion formed in one or two of the portions. The results of the test are shown in Table 2. As similar to Table 1, "o" indicates that no bending occurred and "x" indicates that bending occurred. Since L=2.9 mm, the length of the oxidation portion C included in the embedded portion is 0.9 mm.

TABLE 2

| Oxidation portion formation portion | Number of times of turning on-off 50 | 100 |
|---|---|---|
| Only A | x | x |
| Only B | x | x |
| Only C | ○ | ○ |
| A and B | (○) | (○) |
| A and C | ○ | ○ |
| B and C | ○ | ○ |

As can be understood from Table 2, no bending of the electrode shaft portion occurred in the lamps provided with the oxidation portion only in the portion C, in the portions A and C, and in the portions B and C. Meanwhile, the bending occurred in the lamps provided with the oxidation portion only in the portion A and only in the portion B. In the lamp provided with the oxidation portion in the portions A and B, a failure due to a reason other than the bending of electrode shaft portion occurred or not and it was not confirmed whether the bending occurs. However, conditions related to the position and the area of the oxidation portion is similar to the lamp used in Experiment 2. Hence, it is assumed that no bending occurs.

From the results of Experiments 2 and 3 described above, it is confirmed that the bending of electrode shaft portion can be prevented even in a high-wattage lamp when at least one of the following conditions is satisfied: (1) the oxidation portion covers at least about 30% (≈0.9/2.9) of the embedded portion of the electrode shaft portion on the discharge space side; (2) the oxidation portion covers at least about 65% (≈(0.9+1.0)/2.9) of the embedded portion of the electrode shaft portion.

<Experiment 4>

Next, a life test of the conventional lamps and the lamps of the present invention was performed to confirm that the oxidation portion of the electrode shaft portion has no effect on a lamp life.

Figure 6A:
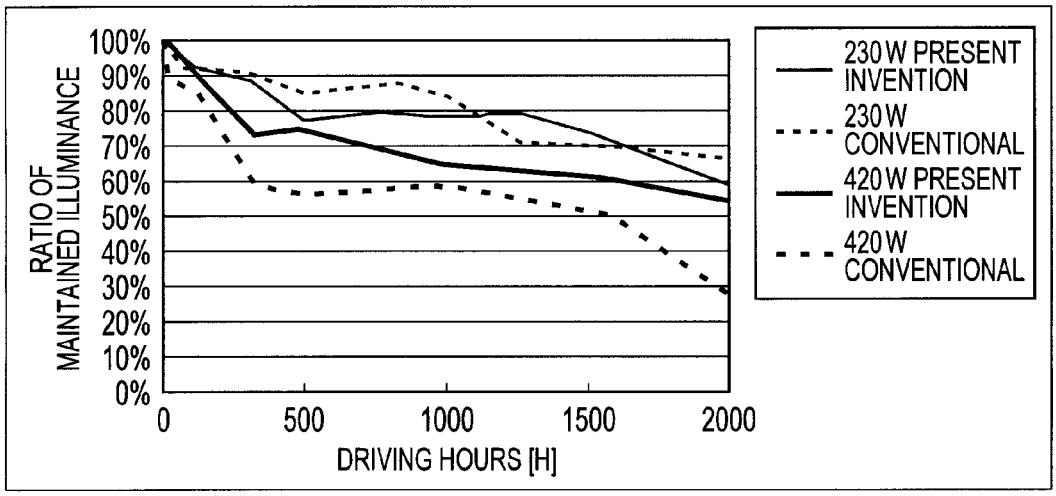
FIG. 6A is a view for confirming the electrode performance of the present invention.
Figure 6B:
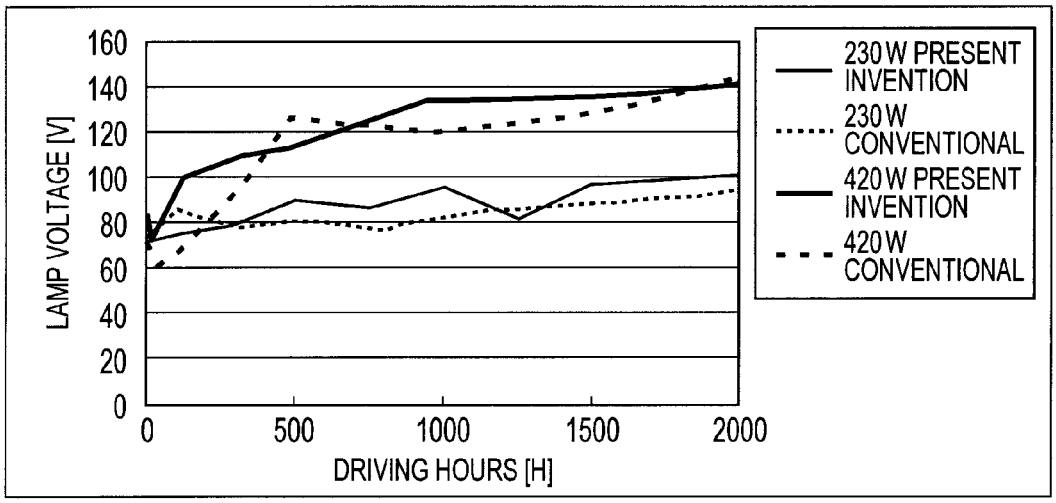
FIG. 6B is a view for confirming the electrode performance of the present invention.
Figure 7:
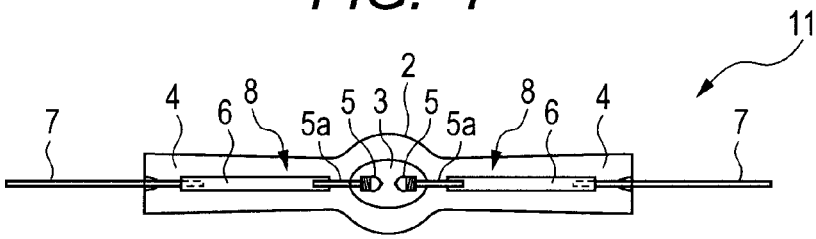
FIG. 7 is a view of a conventional high pressure discharge lamp.

In the experiment, the same lamp (230 W) as the one of Experiment 1 and the lamp (420 W) of Experiment 2 in which the oxidation portion was formed only in the portion C were used and a turning on-off test of 3 hours 30 minutes ON-30 minutes OFF was performed. The results of the experiment are shown in FIGS. 6A and 6B. As shown in the drawings, it can be understood that the lamps of the present invention had similar or better life characteristics than the conventional lamps in terms of illuminance and lamp voltage after elapse of 2000 hours. Hence, it is confirmed that the oxidation portion in the present invention has no effect on the lamp life.

As described above, in the present invention, the manufacturing of the electrode mount for preventing the bending of electrode shaft portion and a high pressure discharge lamp using the electrode mount can be achieved with a minimal additional cost.

Although the embodiment of the present invention has been described above, the present invention can be modified within the scope not departing from the spirit of the invention as follows.

(1) Although the descriptions are given by using the ultra-high pressure mercury lamp as an example in the embodiment, the present invention can be applied to a general high pressure discharge lamp.

(2) Although the oxidation portions are formed respectively in the pair of electrode shaft portions in the embodiment (except for Experiment 1), the oxidation portion may be formed in one of the electrode shaft portions. For example, the oxidation portion may be formed only in an electrode mount (for example, an electrode mount disposed on a reflector mirror neck side when the reflector mirror is attached to the lamp, or an electrode mount disposed on a secondary mirror side when a secondary mirror is attached to the lamp in addition to the reflector mirror) on a high temperature side where the bending of electrode shaft portion is more likely to occur. In this case, as a matter of course, the electrode mount in which the oxidation portion is formed must be identifiable in the completed lamp.

(3) In the embodiment, although the fixed position and the fixed width of the oxidation portion in the axial direction of the electrode are shown, for example, the oxidation portion may be formed in a helical shape or a dot shape with respect to the electrode shaft portion. Such forms are also included in the scope of the present invention. However, in such cases, the electrode shaft portion or the laser irradiation device needs to be rotated with respect to the electrode axis.

| Reference Numerals List | |
|---|---|
| 1. | high pressure discharge lamp |
| 2. | bulb |
| 3. | discharge space |
| 4. | sealing portion |
| 5. | electrode |
| 5a. | electrode shaft portion |
| 5b. | oxidation portion |
| 6. | metal foil |
| 7. | lead wire |
| 8. | electrode mount |
| L. | embedded portion |

The invention claimed is:

1. A manufacturing method of an electrode mount for a high pressure discharge lamp, the manufacturing method comprising:

a process of subjecting the electrode mount to a heat treatment, the electrode mount including an electrode and a metal foil which are welded to each other; and an oxidation process of producing an oxide on a surface of an electrode shaft portion of the electrode by laser irradiation to form an oxidation portion on the surface, wherein a laser irradiation position is determined such that a whole or part of the oxidation portion is included in a sealing portion of the high pressure discharge lamp when the electrode mount is embedded in the sealing portion, and wherein the oxidation process includes determining an intensity of a laser such that the oxidation portion is formed on an entire peripheral surface of the electrode shaft portion by irradiating one side of the electrode shaft portion with the laser.

2. The manufacturing method according to claim 1, wherein (1) the oxidation portion is formed to cover at least 30% of an embedded portion of the electrode shaft portion on a discharge space side or (2) the oxidation portion is formed to cover at least 65% of the embedded portion of the electrode shaft portion.

3. A manufacturing method for a high pressure discharge lamp, comprising the processes of:

subjecting an electrode mount to a heat treatment, the electrode mount having an electrode and a lead wire welded respectively to both ends of a metal foil;

producing an oxide on a surface of an electrode shaft portion of the electrode by laser irradiation to form an oxidation portion on the surface; and embedding the electrode mount in a bulb of the high pressure discharge lamp and forming a sealing portion, wherein a laser irradiation position is determined such that a whole or part of the oxidation portion is included in the sealing portion, and wherein the process of producing the oxide includes determining an intensity of a laser such that the oxidation portion is formed on an entire peripheral surface of the electrode shaft portion by irradiating one side of the electrode shaft portion with the laser.

4. The manufacturing method according to claim 3, wherein (1) the oxidation portion is formed to cover at least 30% of an embedded portion of the electrode shaft portion on a discharge space side or (2) the oxidation portion is formed to cover at least 65% of the embedded portion of the electrode shaft portion.

* * * * *